US012117234B2

(12) United States Patent
Hosamani et al.

(10) Patent No.: US 12,117,234 B2
(45) Date of Patent: Oct. 15, 2024

(54) INNER CONTAINER WITH A CUT-OUT HOLE HAVING A POCKET, DOMESTIC REFRIGERATION APPLIANCE, AND METHOD FOR INSTALLING AN ATTACHMENT ON AN INNER CONTAINER

(71) Applicant: BSH Hausgeraete GmbH, Munich (DE)

(72) Inventors: Prashantagouda Hosamani, Ulm (DE); Robert Stahl, Herbrechtingen (DE)

(73) Assignee: BSH Hausgeraete GmbH, Munich (DE)

( * ) Notice: Subject to any disclaimer, the term of this patent is extended or adjusted under 35 U.S.C. 154(b) by 339 days.

(21) Appl. No.: 17/627,868

(22) PCT Filed: Jul. 9, 2020

(86) PCT No.: PCT/EP2020/069376
§ 371 (c)(1),
(2) Date: Jan. 18, 2022

(87) PCT Pub. No.: WO2021/008995
PCT Pub. Date: Jan. 21, 2021

(65) Prior Publication Data

US 2022/0260305 A1 Aug. 18, 2022

(30) Foreign Application Priority Data

Jul. 18, 2019 (DE) ..... 102019210662.5

(51) Int. Cl.
*F25D 23/06* (2006.01)

(52) U.S. Cl.
CPC ..... *F25D 23/066* (2013.01); *F25D 23/065* (2013.01); *F25D 23/067* (2013.01); *F25D 2201/126* (2013.01)

(58) Field of Classification Search
CPC ..... F25D 23/065; F25D 23/066; F25D 23/08; F25D 2201/126
See application file for complete search history.

(56) References Cited

U.S. PATENT DOCUMENTS 3,264,699 A * 8/1966 Knowlton ..... F16B 9/05 411/968
7,300,120 B2 * 11/2007 Shin ..... F25D 23/04 108/108

(Continued)

FOREIGN PATENT DOCUMENTS

CN 203893567 U * 10/2014
CN 104296486 A * 1/2015 ..... F25D 23/065

(Continued)

*Primary Examiner* — Andrew Roersma
(74) *Attorney, Agent, or Firm* — Laurence A. Greenberg; Werner H. Stemer; Ralph E. Locher

(57) ABSTRACT

An inner container for a domestic refrigeration appliance includes walls that delimit at least portions of a receiving area for food. One of the walls has a cut-out hole on which a separate attachment can be installed in order to at least partly cover the cut-out hole. One end of the cut-out hole adjoins an elevated hole pocket which is formed in the wall and which has a diagonal pocket wall that forms a guide ramp for the attachment when the attachment is installed on the wall. A domestic refrigeration appliance and a method are also provided.

23 Claims, 5 Drawing Sheets

(56) References Cited

U.S. PATENT DOCUMENTS

| | | | | |
|---|---|---|---|---|
| 7,731,315 | B2 * | 6/2010 | Lee | F25D 23/067 312/406 |
| 2018/0172339 | A1 * | 6/2018 | Lindel | F25D 23/066 |

FOREIGN PATENT DOCUMENTS

| | | | | | |
|---|---|---|---|---|---|
| DE | 19730357 | A1 | | 1/1999 | |
| DE | 102006012921 | A1 | * | 9/2007 | A47L 15/4418 |
| DE | 102016220465 | A1 | * | 4/2018 | |
| EP | 0892230 | A1 | * | 1/1999 | F25D 27/00 |
| EP | 1895252 | A2 | * | 3/2008 | F25D 23/065 |
| EP | 2476982 | A2 | * | 7/2012 | F25D 23/065 |
| EP | 2685183 | A2 | | 1/2014 | |
| ES | 2460726 | T3 | * | 5/2014 | E05B 1/0015 |
| JP | S52104164 | U | | 8/1977 | |
| JP | 2011153787 | A | | 8/2011 | |
| KR | 1020110010154 | A | * | 2/2011 | |
| KR | 1020120000285 | A | * | 1/2012 | F25D 23/06 |
| WO | WO-2007107402 | A1 | * | 9/2007 | F25D 23/067 |
| WO | WO-2010089177 | A2 | * | 8/2010 | F25D 23/065 |
| WO | WO-2016134894 | A1 | * | 9/2016 | F25D 17/062 |
| WO | WO-2017140487 | A1 | * | 8/2017 | F21V 19/004 |

* cited by examiner

INNER CONTAINER WITH A CUT-OUT HOLE HAVING A POCKET, DOMESTIC REFRIGERATION APPLIANCE, AND METHOD FOR INSTALLING AN ATTACHMENT ON AN INNER CONTAINER

FIELD AND BACKGROUND OF THE INVENTION

One aspect of the invention relates to an inner container for a household refrigeration appliance. The inner container has walls that delimit at least portions of a receiving area of the inner container for food. A wall of this inner container has a cut-out hole on which a separate attachment can be installed in order to at least partly cover the cut-out hole. The cut-out hole is delimited by an edge contour which is closed over the periphery. A further aspect of the invention relates to a household refrigeration appliance with an inner container. A further aspect relates to a method for installing an attachment on a wall of an inner container for a household refrigeration appliance.

In household refrigeration appliances it is known that an inner container is arranged in an outer housing. An intermediate space which is generally filled with thermally insulating material, such as in particular an insulating foam, is configured between the inner container and the outer housing. This insulating foam, which may be a polyurethane foam, is injected in liquid form into this intermediate space during production. This insulating foam then expands and fills up this intermediate space. After this intermediate space is completely filled up, the internal pressure increases. At this time the insulating foam is not yet hardened and, if present, would be able to escape through small openings, for example into the receiving area. This also applies, in particular, to the inner container. Such an inner container may have such holes or cut-out holes to which additional parts or attachments are attached. These openings are closed by these attachments, optionally with further components attached to the attachments. In this context, a foam-tight arrangement is also intended to be provided.

In order to be able to achieve this to a certain extent, embodiments are known in which sealing screens are configured on such additional parts. So that this sealing screen is sealed relative to the pressure of the insulating foam, a pretensioning of the sealing screen is provided. The installation of the additional part is carried out, for example, by rotation by means of a bayonet connection. Due to the component geometry, however, this is not always possible and a sliding connection is required during the installation of the additional part. In the case of such a sliding connection which is provided when installing the additional part on the inner container in the region of the cut-out hole, in conventional designs the sealing screen has to be pushed over the cut edge or the edge contour of the cut-out hole. The relatively delicate sealing screen collides with this edge contour due to the pretensioning and may be damaged. Due to this potential damage, therefore, the sealing screen is no longer able to bear fully against the wall of the container, whereby disadvantages may be produced in terms of the sealing action. As a result, it may also arise that the insulating foam is no longer able to be completely held back by the sealing screen and may penetrate into the cut-out hole and thus also may optionally at least partly pass through the cut-out hole into the receiving area of the inner container. Such a known design is shown in FIG. 10, which is also described briefly hereinafter.

A refrigeration appliance is disclosed in DE 197 30 357 A1. Here, an inner container is formed by a so-called internal panel. An aperture which is delimited by an edge contour so as to be closed over the periphery is configured in a wall of this inner panel. This edge contour, when viewed along its longitudinal axis or its length, is formed entirely in a plane in which the aperture also extends. It is also provided that a lighting apparatus, which is arranged on the wall of the inner panel in the region of the aperture, is provided on both sides. A sub-component of this multipart lighting apparatus is arranged on an outer face of the wall and thus is arranged in the intermediate space between the inner panel and an outer panel. This component is an insert part which has a deformable sealing lip over the periphery. In the mounted state this sealing lip bears against the outer face of the wall of the inner panel and thus the aperture is designed to be sealed thereby. In this prior art, the installation of this insert part is such that it is is applied against the wall in the direction of the aperture axis which is oriented perpendicular to the surface of the aperture, and thus the installation direction is perpendicular to the plane of the aperture. The insert part is sufficiently large that the entire sealing lip bears against the outer face entirely outside the aperture, even before the displacement of the insert part.

Such an embodiment also has the drawback that a positional inaccuracy may occur relative to the aperture, since due to this specific installation direction, in particular, a substantially symmetrical mounting of the position and shape of the aperture may also not be achieved. Therefore, this may also result in undesired positions which impair the sealing action. Moreover, the insert part is relatively large in comparison with the aperture so that a large planar surface has to be present around the aperture in order to be able to apply the sealing lip fully thereon.

SUMMARY OF THE INVENTION

It is an object of the present invention to provide an inner container and a household refrigeration appliance in which a separate attachment which, in particular, is able to be installed or is installed on the wall of the inner container, in particular on the cut-out hole, with an installation direction which is oriented parallel or substantially parallel to a cut-out hole in a wall of the inner container, and which may be moved over the cut-out hole in an improved manner during this installation. Moreover, it is also an object to provide an installation method which permits a more careful sealing procedure when installing the attachment on the wall of the inner container, in particular on the cut-out hole.

This object is achieved by an inner container, a household refrigeration appliance and a method as claimed in the independent claims.

One aspect of the invention relates to an inner container for a household refrigeration appliance. The inner container has walls that delimit at least portions of a receiving area for food of the inner container. A wall of the inner container has at least one cut-out hole. The cut-out hole is formed as a continuous aperture in the wall. A separate attachment is able to be installed on this wall in the region of the cut-out hole in order to at least partly cover the cut-out hole. The attachment, therefore, is configured separately relative to the wall and, in particular, relative to the inner container. In particular, therefore, the wall is designed in such a manner that such an installation of an attachment may be carried out in a specific manner, namely in the region of this cut-out hole. In particular, the wall is configured such that an installation of such a separate attachment may be carried out such that it at least partly or fully covers the cut-out hole. It is conceivable, for example, that the attachment fully covers an edge contour of the cut-out hole, which is in particular closed over the periphery, wherein however the attachment may have an opening through which, for example, a line may be passed into the receiving area. One end of the cut-out hole adjoins an elevated hole pocket which is formed in the wall. In other words, the hole pocket, in particular an edge contour of the hole pocket, delimits the cut-out hole at the end. This hole pocket has a diagonal pocket wall that forms a guide ramp for the attachment, in particular for a resilient portion of the attachment, when the attachment is installed on the wall, in particular on the cut-out hole. The hole pocket is configured, in particular, in one piece on the wall. By means of this embodiment the cut-out hole is also designed such that it does not extend in one plane. Due to the elevated hole pocket adjoining the cut-out hole on the end side, an uneven shape of the edge contours of the cut-out hole is also formed.

By means of such an embodiment of the cut-out hole, it is possible that when installing the separate attachment, the attachment, in particular a resilient portion of the attachment, may be guided away or in particular pushed away in an improved manner at this end of the cut-out hole. In particular, as a result the attachment may be installed more carefully and with reduced wear.

It is preferably provided that the hole pocket extends over a clear width of the cut-out hole and/or the diagonal pocket wall extends over a clear width of the cut-out hole. The cut-out hole, for example, has a length and a breadth. In this context, the hole pocket or the diagonal pocket wall extends, in particular, entirely over one of these two dimensions, in particular over the clear width of the breadth.

In particular, the hole pocket may have a substantially elongated shape, for example a length of the hole pocket may be larger by a multiple than a breadth of the hole pocket. In this case, in particular, a substantially rectangular cut-out hole may be provided. In such an embodiment, the end of the cut-out hole which adjoins the hole pocket is formed by one of the two narrow sides, in particular by a region with this narrow side, of this rectangular shape. In particular, therefore, the hole pocket extends over the entire extent of this narrow side of this rectangular shape.

It may be provided that the hole pocket, in particular the diagonal wall, is integrally formed in the manner of a spoiler in the wall adjoining the end of the cut-out hole.

The hole pocket may protrude from a plane of the wall in a direction which faces toward or faces away from the receiving area. In particular, therefore, a corresponding elevated portion or recess in the form of the hole pocket is formed on the inner face of the wall. Preferably, it is provided that the hole pocket protrudes from the wall in the direction of the receiving area.

The cut-out hole is delimited, in particular, by an edge contour. In this case, the cut-out hole may be delimited by an edge contour which is closed over the periphery. The cut-out hole in this case is not a cut-out which is open on the edge side. The cut-out hole may be punched into the wall of the inner container.

In an advantageous embodiment, it is provided that the edge contour which delimits the cut-out hole has a first edge contour portion which, when viewed in its longitudinal extent and thus over its length, extends in a plane from which the hole pocket extends. In particular, the diagonal pocket wall may lead with an end edge of the pocket wall onto the wall of the inner container in which the cut-out hole is configured, wherein this end edge extends in this aforementioned plane. This also means that although this pocket wall extends from the plane of the remaining cut-out hole, it is arranged on the end side, namely on the end edge, such that it is arranged starting at the level of this plane.

An angle between the diagonal pocket wall and a plane which is formed by the edge contour of the cut-out hole, with the exception of the hole pocket, may be between 20 degrees and 70 degrees or between 30 degrees and 60 degrees. The resulting diagonal position of the diagonal pocket wall permits the attachment to slide along in an advantageous manner.

In the case of a perpendicular projected view onto the wall, the hole pocket is arranged such that it adjoins a region formed by the cut-out hole.

In an advantageous embodiment, it is provided that the transition from the end edge of the diagonal pocket wall into the wall of the inner container, in which the cut-out hole is configured, is configured without edges. In particular, the transition may be formed by a radius, for example a radius greater than 0.1 cm or greater than 0.3 cm or greater than 0.5 cm and/or smaller than 3.0 cm or smaller than 2.0 cm or smaller than 1.0 cm. This is a further substantial advantage since it is permitted thereby that when the attachment is displaced when installed on the wall with the cut-out hole, the attachment, in particular a resilient portion of the attachment, may initially come into contact with the diagonal pocket wall, then may slide along this wall and no edge is present at this transition when it slides over from the diagonal pocket wall to the wall. In particular, it is permitted thereby in a particularly advantageous manner that the attachment, in particular a resilient portion of the attachment, when moving relative to the diagonal pocket wall at the transition is not undesirably stressed thereby, in particular is not damaged. In particular, the attachment, in particular a resilient portion of the attachment, may be positioned such that a particularly advantageous mechanically comprehensive contact and bearing against the outer face of the wall is possible in the installed end state.

Preferably it is provided that the hole pocket has an edge contour portion which forms a stop for the attachment. As a result, the hole pocket is designed to be multifunctional. This is because it permits, on the one hand, an improved guidance of the attachment, in particular a resilient portion of the attachment, when during the installation of the attachment this attachment (or the resilient portion) slides or is able to slide along the diagonal pocket wall. On the other hand, therefore, a defined end position of the attachment on the wall may also be predetermined by this stop. The stop is arranged outside a plane in which the remaining cut-out hole extends in a planar manner and thus the stop may come into contact with the attachment on a counter stop of the attachment at a distance from the plane. The counter stop may thus be configured at a preferred position on the attachment.

Preferably the wall has a base which is configured, in particular, in one piece therewith and the cut-out hole is configured in a top wall of the base at least in some regions, but in particular entirely, therein. The base protrudes, in particular in an elevated manner, from a main extension plane of the wall. The main extension plane in this case is a plane in which a large part of the wall—with the exception of the base—extends in a planar manner. Such a base or such a raised area enables the volume of the receiving area to be less restricted by further attachments which are optionally additionally installed on the receiving area side, provided the base extends in a direction facing away from the receiving area. With a predetermined or desired volume of the receiving area, therefore, the space for accommodating the further attachments is increased.

Preferably, in the case of a perpendicular projected view onto the top wall of the base, a total surface of a cut-out portion of the cut-out hole is less than 100% and at least 70%, in particular at least 80%, of a total surface of the top wall. It is possible that a top wall edge is configured as a planar strip over the entire periphery around the cut-out hole. In particular a strip width of the planar strip, at least on average, is less than 4.0 cm, in particular less than 3.0 cm, in particular less than 2.0 cm, preferably between 0.5 cm and 3.0 cm. In particular, this applies to any position when viewed in the peripheral direction around the cut-out hole.

A further aspect of the invention relates to a household refrigeration appliance. The household refrigeration appliance has a housing. This housing has an outer housing and an inner container. The inner container is arranged in the outer housing. In particular, the inner container is configured according to an aforementioned aspect or an advantageous embodiment thereof. An intermediate space is configured between the inner container and the outer housing. This intermediate space is filled at least in some regions with a thermally insulating material, in particular an insulating foam. An attachment of the household refrigeration appliance which is at least partly arranged in the intermediate space and which at least partly covers the cut-out hole in the wall of the inner container is installed on the inner container. In particular, this attachment is substantially arranged on the outer face of the wall of the inner container facing away from the receiving area, i.e. a large part of a volume of the attachment is located in the intermediate space. In particular, therefore, the attachment is arranged at least partly on the foam side.

In an advantageous embodiment, it is provided that the attachment has a resilient portion. A resilient portion in this case is to be understood to mean, in particular, a portion which is resiliently deformable by a smaller force or is more resiliently deformable with a predetermined force relative to the remaining attachment. The resilient portion may be formed by a material which has a greater resilience relative to a material of the remaining attachment. It is also conceivable that the resilient portion has walls or is formed by one, two or more walls which are configured to be thin-walled relative to the walls of the remaining attachment.

According to one embodiment, it is provided that the attachment has a sealing element which bears against an outer face of the inner container which faces the intermediate space, in particular when the attachment is arranged in the installed end position. The attachment in this case is arranged such that it at least partly or fully covers the hole pocket toward the intermediate space and the sealing element outside the hole pocket bears against the outer face of the inner container. The sealing element may be formed, in particular, by the resilient portion. In particular, this sealing element is a diagonally inclined sealing lip. In particular, this sealing element is configured entirely over the periphery, in particular is configured without interruption over the periphery. The sealing element, therefore, may form a sealing screen. The sealing lip, in particular, is also configured as a sealing collar which is closed over the periphery.

According to one embodiment, it is provided that the attachment is configured in one piece. For example, the attachment may be a plastic injection-molded component.

According to one embodiment, the wall is a rear wall of the inner container.

According to one embodiment, it is provided that the diagonal pocket wall has a substantially uniform wall thickness. In particular, it may be provided that the wall of the inner container has a uniform wall thickness.

The diagonal pocket wall, in particular the wall of the inner container, may be configured, in particular, to be thin-walled.

According to one embodiment, it is provided that, in the installed state of the attachment, coupling elements on the attachment are coupled to counter-coupling elements on the wall. The attachment is thereby prevented from falling out of the cut-out hole even before the attachment is fastened by means of insulating foam on the rear face. The coupling elements and counter-coupling elements may be projections or runners or grooves or the like.

A further aspect of the invention relates to a method for installing a separate attachment on a wall of an inner container for a household refrigeration appliance. The attachment is pushed against an outer face of the inner container over or along the cut-out hole, in an installation direction which is oriented perpendicular, or substantially perpendicular, to a hole axis of a cut-out hole formed in the wall. The hole axis, in particular, is perpendicular to the surface of the cut-out hole. The cut-out hole, which is delimited in particular by an edge contour which is closed over the periphery, is delimited at one end or rear end, when viewed in this installation direction, by an elevated hole pocket facing away from the outer face of the inner container. The hole pocket is configured, in particular, in one piece in the wall. The hole pocket has a diagonal pocket wall that forms a guide ramp for the attachment, in particular for a resilient portion of the attachment, when the attachment is installed on the wall, in particular on the cut-out hole. In the case of a resilient portion, this is, in particular, a resilient sealing element. With the displacement of the attachment in this installation direction, the attachment, in particular the resilient portion of the attachment, is positioned at least in phases with a partial portion or a partial element such that it protrudes or is able to protrude in the direction of the hole axis into the cut-out hole. When the attachment reaches the region of the end of the cut-out hole, the attachment, in particular a possibly present resilient portion of the attachment, comes into contact with the diagonal pocket wall and, with the further displacement of the attachment in this installation direction perpendicular, or substantially perpendicular, to the hole axis of the cut-out hole, the attachment, in particular a possibly present resilient portion of the attachment, is guided along the diagonal pocket wall or slides along this pocket wall. With the further displacement of the attachment in the installation direction relative to the cut-out hole, the attachment, in particular a possibly present resilient portion of the attachment, is guided over a transition between the diagonal pocket wall and the wall of the inner container until it bears against the outer face outside the cut-out hole in the installed end position. For such an installation scenario a more careful installation of the attachment is achieved in this specific installation direction, which is not implemented in the direction of the hole axis and thus not perpendicular to the cut-out hole, but substantially requires a displacement carried out parallel to the plane of the cut-out hole. This is because when the attachment has a resilient portion, which is pushed over the cut-out hole and thus extends in the direction of the hole axis into the cut-out hole, in particular also optionally extends therethrough, due to the pretensioning with the partial portion which is located above the cut-out hole, the resilient portion is not abruptly pushed, at this end of the cut-out hole formed in the installation direction, against a sharp edge located in the plane of the cut-out hole or against this edge contour portion, and is not bent over significantly counter to the installation direction and/or not abraded and/or not torn and/or not frayed. However, before reaching this rear defining region of the cut-out hole, the attachment may come into contact with the diagonal pocket wall and then is also defined by this diagonal pocket wall and gently guided, in particular gently guided across the transition. The resilient portion, for example the sealing element, is thus moved carefully and also with reduced wear when pushed across the cut-out hole into its end position located outside the cut-out hole.

This is advantageous, in particular, when the resilient portion is a sealing element with a diagonally positioned sealing lip. In particular, the diagonal orientation of the portion of the sealing lip, which protrudes during installation into the cut-out hole, is oriented in the direction of the installation direction and diagonally downwardly away from the cut-out hole. In particular, this orientation of the sealing lip is opposite the diagonal position of the hole pocket wall. The inclinations of the sealing lip and the diagonal pocket wall are thus oriented opposingly. As a result, the scenario set forth above may be implemented particularly advantageously. In this context, the diagonal orientation of the sealing lip facing the diagonal pocket wall also permits that, on the one hand, the contact between the sealing lip and the diagonal pocket wall is implemented very gently and with a careful sealing procedure. On the other hand, the sliding of the sealing lip along the diagonal pocket wall may also be carried out in a guided manner such that the sealing lip is not bent over, or does not otherwise fold or bulge, when oriented in the direction of the cut-out hole.

In an advantageous embodiment it is provided that the attachment is pushed sufficiently far over the cut-out hole until a projection of the attachment bears against a free edge contour portion of the hole pocket which extends outside a plane in which the remaining edge contour portion of the edge contour extends without the hole pocket. As a result, an accurate adjustment of the end position of the attachment is possible relative to the cut-out hole on the wall of the inner container. Therefore the attachment, in particular a resilient portion of the attachment, may bear in particular against the outer face of the wall over its entire length. In the end position the attachment preferably fully covers the entire surface of the cut-out hole, but at least an edge contour of the cut-out hole.

Preferably, in the intermediate installed position, from which the further installation of the attachment is carried out by displacement in the installation direction, the attachment is positioned such that, when viewed in this installation direction, a portion of the attachment, for example a resilient portion, which faces the hole pocket and is located closest thereto is positioned with an outer end region on the pocket wall. In the case of a resilient portion, therefore, it is possible that a relatively small resilient portion, in particular a sealing element, may be produced. This sealing element is thus arranged in the intermediate installed position, however, in the case of a perpendicular projected view onto the cut-out hole, outside the surface of the cut-out hole. Such a small sealing element is advantageous, in particular, when the surface region against which this sealing element bears, in the end position of the attachment, is of a small size. This means that the planar region of this surface against which the entire sealing element bears is small and is only configured, for example, as an edge surface over a narrow periphery around the cut-out hole. In particular, this is the case when this surface is a top wall of an elevated base or raised area, which is configured so as to be integrated in the wall, and the cut-out hole is entirely configured in the top wall. In such limited circumstances the sealing element has to be designed to be smaller and, due to the relatively short displacement path during the installation of the attachment into the end position, this position of the sealing element is required in the intermediate installed position. Specifically in these embodiments, therefore, the hole pocket with its pocket wall is particularly advantageous.

Preferably, in a preliminary installation step the attachment is positioned onto the wall in a direction perpendicular to the installation direction, such that the attachment extends into the cut-out hole and as a result an intermediate installation position is reached, starting from which the further installation is carried out by the displacement in the installation direction. Thus the displacement takes place, in particular, only as a second installation step in which the attachment is already immersed in the cut-out hole.

In particular, it is provided that coupling elements on the attachment are coupled to counter-coupling elements on the wall. In particular, this is carried out at least from the intermediate installation position when the displacement in the installation direction is carried out parallel, or substantially parallel, to the surface plane of the cut-out hole. In particular, the end position of the attachment on the wall is held by the coupled state of the coupling elements to the counter-coupling elements. The attachment is prevented thereby from falling out of the cut-out hole. The coupling elements and counter-coupling elements may be projections or runners or grooves or the like.

The method according to the invention may be carried out, in particular, in combination with an inner container according to the invention so that all of the features mentioned relative to the inner container according to the invention are also able to be transferred relative to the method and vice versa.

The positions and orientations provided when the inner container is used as intended and arranged as intended are specified by the terms "top", "bottom", "front", "rear", "horizontal", "vertical", "depth direction", "breadth direction", "vertical direction", etc.

Further features of the invention are revealed from the claims, the figures and the description of the figures. The features and combinations of features mentioned above in the description, as well as the features and combinations of features mentioned below in the description of the figures and/or shown individually in the figures, are not only able to be used in the respectively specified combination but also in other combinations without departing from the scope of the invention. Thus embodiments which are not explicitly shown and described in the figures, but which are revealed and able to be generated by separate combinations of features from the described embodiments, are also to be regarded as encompassed and disclosed by the invention. Embodiments and combinations of features which thus do not have all of the features of an originally formulated independent claim are also to be regarded as disclosed. Moreover, embodiments and combinations of features which depart or deviate from the combinations of features set forth in the back references to the claims are to be regarded as disclosed, in particular, by the embodiments set forth above.

Exemplary embodiments of the invention are described in more detail hereinafter with reference to schematic drawings.

DETAILED DESCRIPTION OF THE INVENTION

Figure 1:
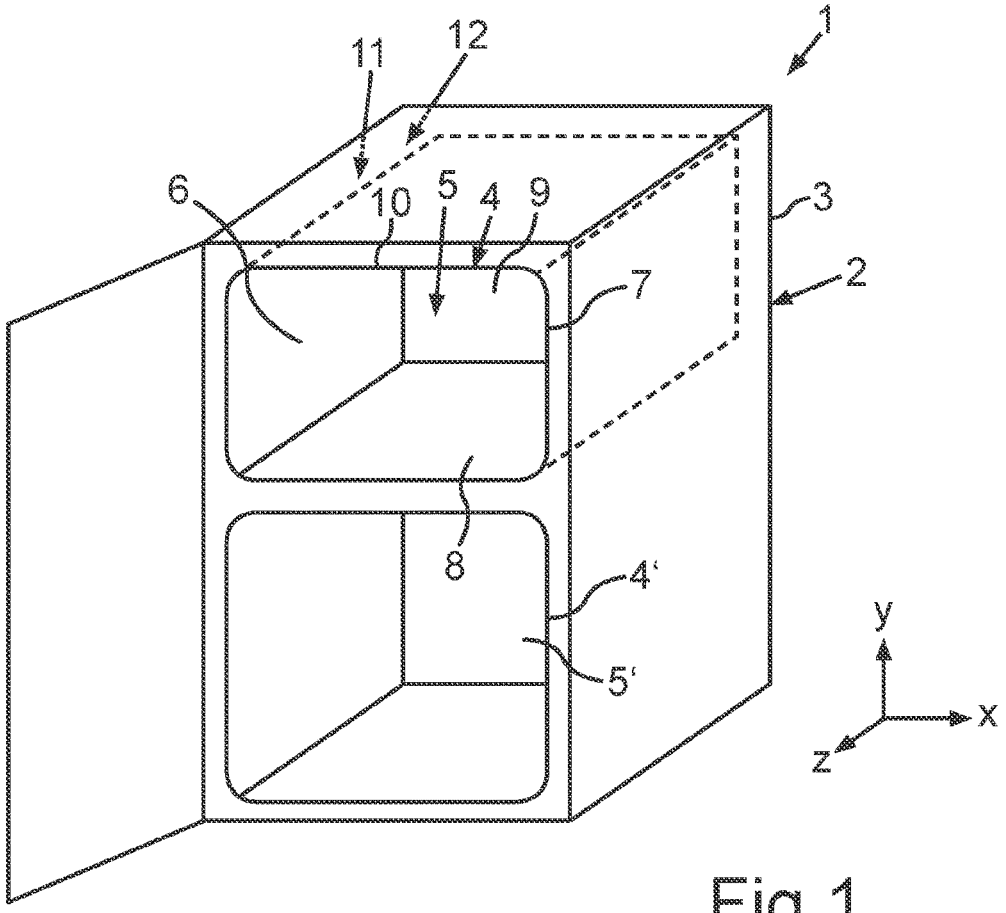
FIG. 1 shows a schematic view of an exemplary embodiment of a household refrigeration appliance according to the invention.

Elements which are the same or functionally the same are provided with the same reference numerals in the figures.

A household refrigeration appliance 1 is shown in a schematic view in FIG. 1. The household refrigeration appliance 1 is configured for storing and preserving food. The household refrigeration appliance 1 may be a refrigerator or a freezer or a combined fridge-freezer. The household refrigeration appliance 1 has a housing 2. The housing 2 has an outer housing 3 and at least one inner container 4 which is separate therefrom. The inner container 4 delimits a receiving area 5 with walls. The walls may have two opposing vertical side walls 6 and 7, a bottom wall 8, a rear wall 9 and a top wall 10. The inner container 4, in particular, is made of plastic material. The outer housing 3, in particular, is made of metal. The inner container 4, in particular, is configured in one piece.

It may also be provided that the household refrigeration appliance 1 has a further inner container 4' which delimits a further receiving area 5'.

A thermally insulating material is introduced into an intermediate space 11 between the outer housing 3 and the inner container 4. In particular, this intermediate space 11 is filled at least in some regions with an insulating foam 12.

Figure 2:
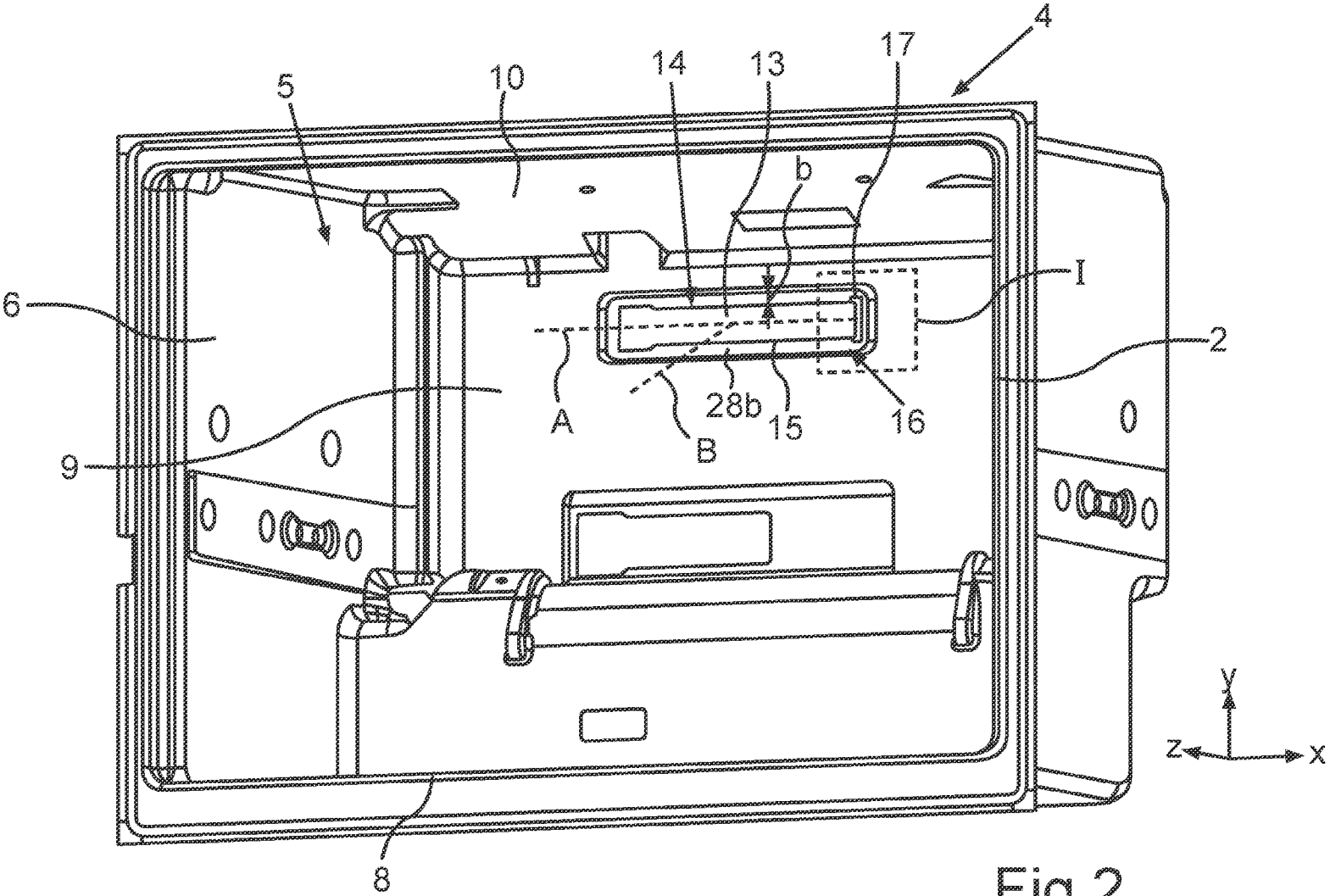
FIG. 2 shows a perspective view of an exemplary embodiment of an inner container according to the invention.

In FIG. 2 an exemplary embodiment of the inner container 4 is shown in a perspective view. A cut-out hole 13 is formed in at least one wall, here by way of example in the rear wall 9. The cut-out hole 13 is formed here as an elongated continuous aperture in the rear wall 9. In particular, the cut-out hole 13 is formed to be substantially rectangular. The longitudinal axis A of the cut-out hole 13 is oriented here in the breadth direction (x-direction). A hole axis B of the cut-out hole 13 is oriented perpendicular to this longitudinal axis A and thus is also oriented perpendicular to the plane of the rear wall 9. The hole axis B is oriented perpendicular to the cut-out portion which forms the cut-out hole 13 or is oriented perpendicular to a surface of the wall enclosing the cut-out hole 13.

The cut-out hole 13 is delimited or enclosed fully over the periphery. To this end, an edge contour 14 is provided. The edge contour 14 has a first edge contour portion 15. This first edge contour portion 15 extends in particular in one plane, when viewed over its length. The first edge contour portion 15 in this case has three substantially straight edge contour portions. This plane corresponds, in particular, to the plane in which the rear wall 9 extends or which corresponds to a main extension plane of the rear wall. In particular, this plane in which this first edge contour portion 15 extends is spanned by the vertical direction (y-direction) and the breadth direction (x-direction).

Figure 3:
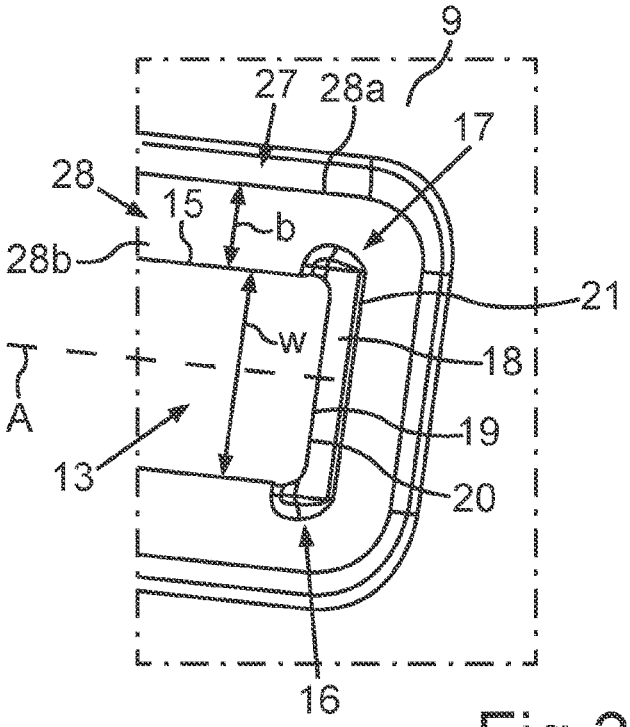
FIG. 3 shows an enlarged partial view of the partial section of FIG. 2 in which a partial region of a cut-out hole is shown with an integrally formed hole pocket.

At one end 16 the cut-out hole 13 adjoins an elevated pocket hole 17. This means that this pocket hole 17 protrudes from the plane in which the first edge contour portion 15 extends. In particular, this elevated pocket hole 17 is configured to be elevated facing the receiving space 5. In particular, this elevated pocket hole 17 has the shape of a spoiler. As may be identified, this elevated pocket hole 17 extends along a breadth of the cut-out hole 13, viewed here in the vertical direction. The breadth corresponds to the clear width W (FIG. 3). In particular, this elevated pocket hole 17 extends without interruption along the entire breadth, i.e. narrow side, of the cut-out hole 13.

The section I in FIG. 2 is shown enlarged in FIG. 3. It may be identified that this hole pocket 17 has a diagonal pocket wall 18. The diagonal pocket wall 18 extends toward the receiving area 5. This diagonal pocket wall 18 has an exposed edge contour 19 which forms the second edge contour portion 20 of the entire edge contour 14 of the cut-out hole 13. The diagonal pocket wall 18 also has an end edge 21 which opposes this second edge contour portion 20. This end edge 21 is located, in particular, in the plane in which the first edge contour portion 15 extends over its entire length.

Figure 4:
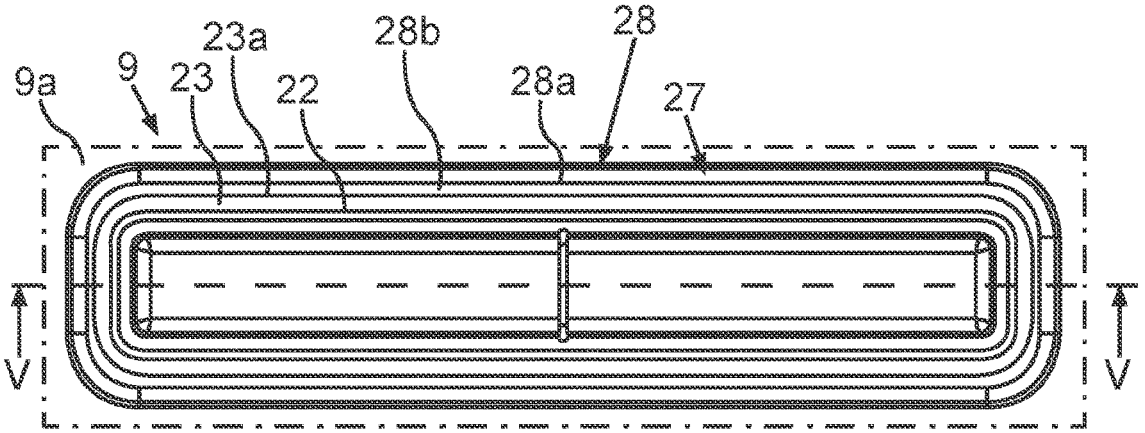
FIG. 4 shows a partial view of the inner container according to FIG. 2 with a separate attachment installed therein in an end position.

In FIG. 4 a partial section of the rear wall 9 is shown. The view in FIG. 4 is such that the view is of an outer face **9*a* of the rear wall 9 which faces the intermediate space 11. As may be identified, a separate attachment 22 is shown in an end position on the rear wall 9. The attachment 22 fully covers the cut-out hole 13 toward the intermediate space 11. In particular, this attachment 22 is arranged on the outer face 9*a***.

Figure 5:
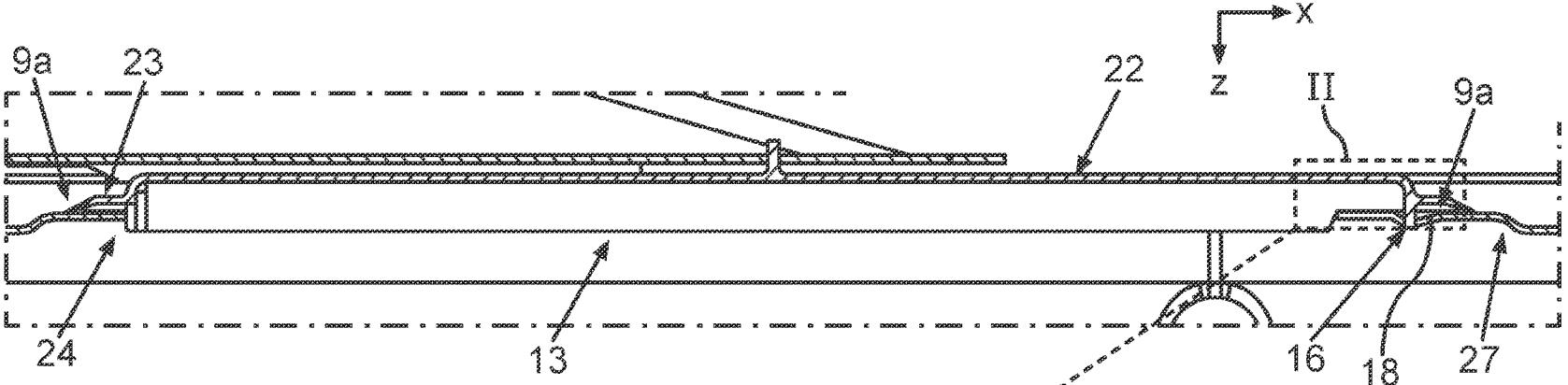
FIG. 5 shows a sectional view through the embodiment in FIG. 4.

In FIG. 5 a sectional view is shown of the components according to FIG. 4 along the cutting line V-V. It may be identified that the attachment 22 bears against the outer face **9*a* with a resilient portion, here a resilient sealing element 23. The sealing element 23, in particular, is a freely protruding sealing lip. In particular, a pretensioned bearing is provided here. This resilient sealing element 23** is configured entirely over the periphery and also without interruption.

In the sectional view in FIG. 5 the diagonal pocket wall 18 which is joined to the end 16 of the cut-out hole 13 or adjoins this end 16 may also be identified. The corresponding pocket hole 17 is configured only at this end 16. No hole pocket is provided on an opposing front end 24 of the cut-out hole 13 in the direction of the longitudinal axis A.

Figure 6:
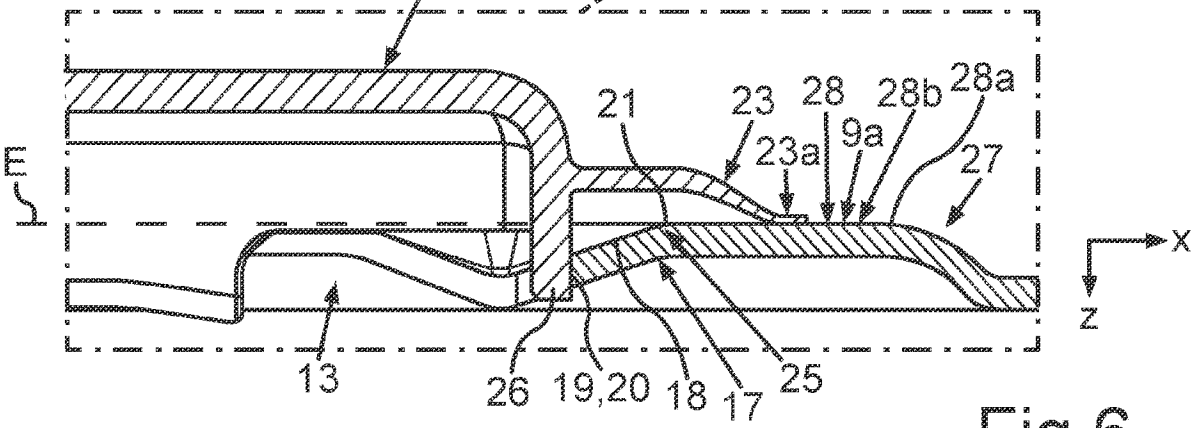
FIG. 6 shows an enlarged view of a partial section of FIG. 5.

As may be identified in FIG. 6 in the enlarged view of the section II of FIG. 5, the cut-out hole 13 is located with the first edge contour portion 15 in a plane E. Accordingly, the hole pocket 17 is formed protruding in an elevated manner to the front from the plane E in the depth direction (z-direction). Thus the edge contour 19 and thus the second edge contour portion 20 are also not formed in this plane E. However, the end edge 21 is in turn located in this plane E.

As may also be identified, a transition 25 between the pocket wall 18 and the outer face **9*a* of the rear wall 9 is configured without edges. This means that an abrupt sharp edge is not configured here. In particular, this transition 25 is configured to be rounded. As a result, a guidance is possible of the front end region 23***a* or the front tip of the sealing element 23 which is gentle and thus also without jamming and spreading and without folding and without bending over toward the rear, when the sealing element slides along the diagonally positioned pocket wall 18 and is guided over the transition 25, in particular adopts the end position shown in FIG. 6.

Figure 7:
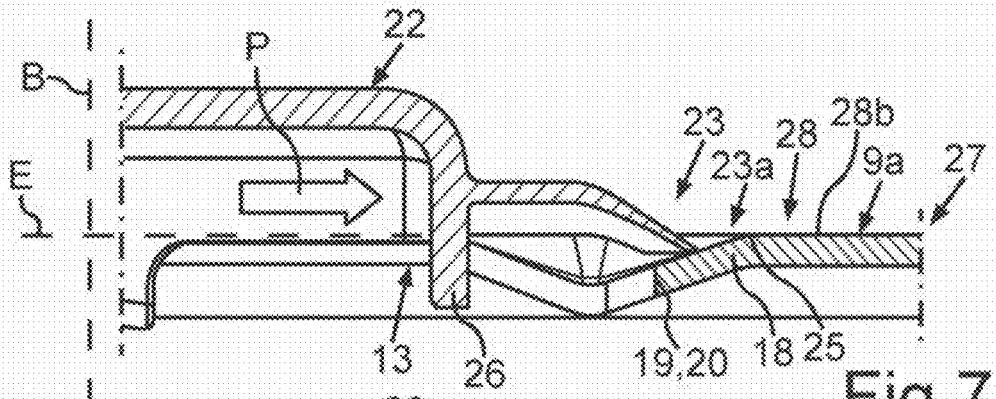
FIG. 7 shows a sectional view through an attachment and a wall with the cut-out hole of the inner container in an intermediate installed position.

In FIG. 7 a sectional view corresponding to the cutting line V-V of the sub-components according to FIG. 6 is shown, wherein an intermediate installation position which is achieved after carrying out a preliminary installation step described below is shown here. In this intermediate installation position the (further) installation takes place by displacing the attachment 22 in the installation direction, shown by the arrow P. The installation direction P of the attachment 22 is thus parallel, or substantially parallel, to the plane E. In particular, therefore, this installation direction P is perpendicular, or substantially perpendicular, to the hole axis B. The attachment 22 is thus pushed along the cut-out hole 13, starting from the first end 24 of the cut-out hole 13 (the reference is to be understood relative to this installation direction P). That partial portion of the sealing element 23, which does not already slide along the outer face 9*a* during this displacement but is guided across the cut-out hole 13, is immersed in the cut-out hole 13 or through this cut-out hole in the direction of the receiving area, due to the pretensioning of the sealing element 23, and thus does not bear against the outer face 9*a*. This partial portion protrudes into the cut-out hole 13 and below the plane level of the outer face 9*a*. In particular, according to the view in FIG. 7 it may be identified that the sealing element 23 is diagonally positioned on its outer end region 23*a*. This diagonal position is oriented outwardly (in the plane E and relative to the cut-out hole) or to the side and downwardly or toward the cut-out hole 13, wherein here reference is made to the view in FIG. 7. Accordingly, the diagonal pocket wall 18 is arranged so as to be inclined in the opposing direction. As a result, as may be identified in FIG. 7, when displacing the attachment 22 in the installation direction P this diagonally positioned outer end region 23*a* may come into gentle contact with the opposing diagonally oriented pocket wall 18 and with further displacement in the installation direction P this end region 23*a* of the sealing element 23 slides along this diagonal pocket wall 18 gently and substantially without having to be folded back or bent back to the rear. In particular, the position shown in FIG. 7 of the attachment 22 is an intermediate installation position. This is preferably achieved by the attachment 22 being initially positioned or inserted in a preliminary installation step from the outside (i.e. onto the outer face 9*a*) in the direction of the hole axis B into the cut-out hole and as a result is positioned according to FIG. 7. By way of example, in this intermediate installation position in which, in particular, still no displacement takes place in the installation direction P, the end region 23*a* is already positioned on the pocket wall 8. This means that the extent of the diagonal pocket wall 18 in the direction of the longitudinal axis A is dimensioned such that the end region 23*a* overlaps therewith. Preferably, therefore, before the start of the displacement of the outer part 22 in the installation direction P the end region 23*a* is already arranged in the direction of the longitudinal axis A so as to overlap with the diagonal pocket wall 18. In particular, it may also be provided at the same time that the end region 23*a* already directly bears against the pocket wall 18.

Figure 8:
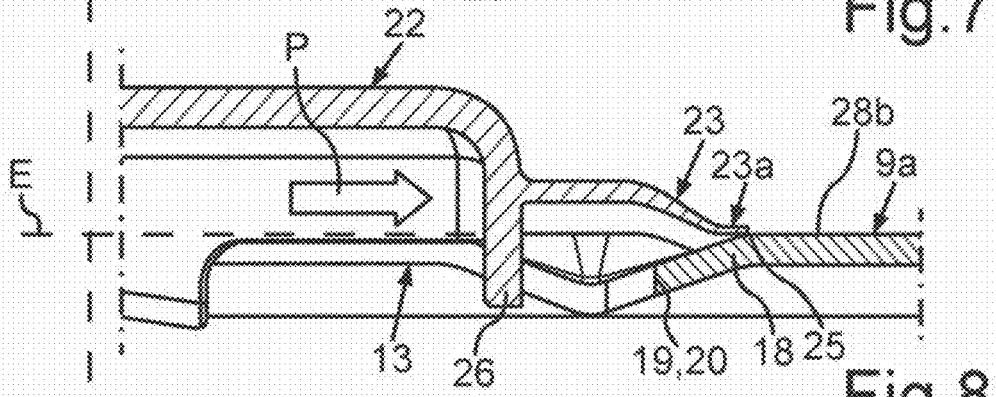
FIG. 8 shows the view according to FIG. 7 in a further installation step following FIG. 7.

In FIG. 8 a further installation state is shown in which this front end region 23*a* reaches the transition 25. Due to the design of the transition 25 without edges, this outer end region 23*a* slides gently across said transition. At this point, therefore, the situation is also avoided that the sealing element 23 is undesirably folded or bent back. Moreover, the front edge of this end region 23*a* is not undesirably affected, in particular not frayed or torn or the like.

Figure 9:
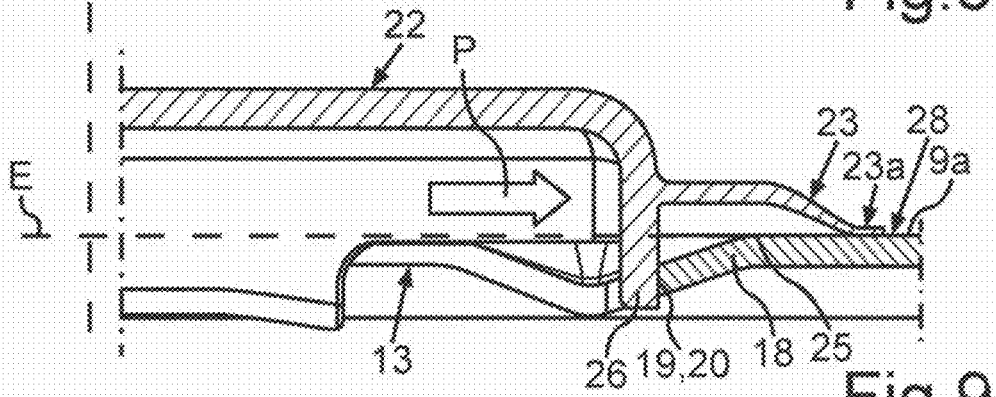
FIG. 9 shows the view according to FIGS. 7 and 8 in a further installation step following FIGS. 7 and 8.

Thus an installation state following FIG. 8 is shown in FIG. 9, which in this case shows the end position of the attachment 22. A pretensioned support or bearing of the sealing element 23 on the outer face 9*a* is entirely formed outside the cut-out hole 13. In this position a coupling projection 26 of the attachment 22, which protrudes into the cut-out hole 13, bears against the edge contour 19 and thus against the second edge contour portion 20. Therefore a stop for the attachment 22 is also formed by the hole pocket 18.

As may be identified in FIG. 2 to FIG. 9, in this exemplary embodiment it is provided that a base 27 or raised area configured in one piece therewith is configured on the rear wall 9. The cut-out hole 13 is formed in this base 27. As a result, the sealing element 23 in the end position of the attachment 22 bears against the rear wall 9 on an outer wall portion of the outer face 9*a* which is elevated relative thereto. This elevated outer wall portion is a top wall 28 of the base 27. The top wall 28 is delimited by a top wall edge 28*a*. The top wall 28 is arranged with its surface in one plane. The cut-out hole 13, with a projected view perpendicular to the top wall 28, is configured entirely within the top wall 28. The cut-out portion of the cut-out hole 13 is in this regard at least 70% of the surface of the top wall 28 without the cut-out hole 13. A top wall strip 28*b* is configured with a breadth b which is between 0.5 cm and 3 cm, in particular between 0.5 cm and 2 cm. The top wall strip 28*b* is configured so as to be closed over the periphery and the breadth b is of equal size, substantially at each point in the peripheral direction around the cut-out hole 13. In the installed end position of the attachment 22, the outer end region 23*a* is positioned over its entire length on the outer face of the top wall strip 28*b*. The end region 23*a* is thus arranged in the narrow surface strip so as to be positioned between the edge contour 14 of the cut-out hole 13 and the top wall edge 28*a*.

Figure 10:
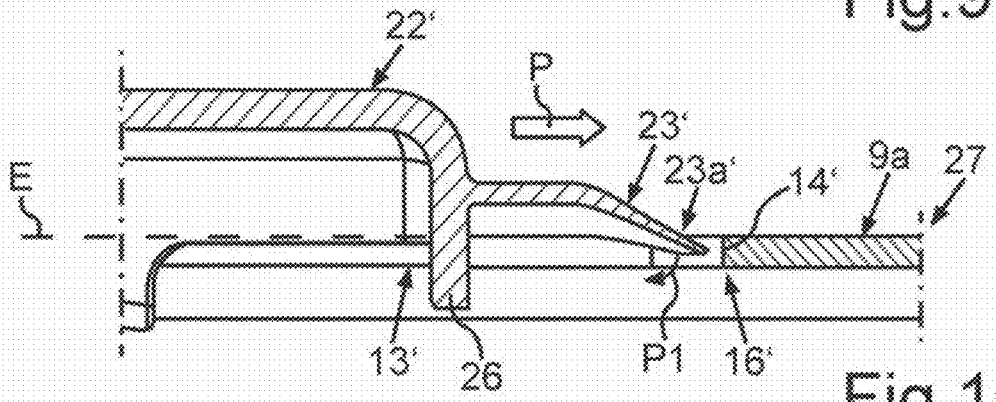
Fig.10 PRIOR ART
FIG. 10 shows a sectional view according to FIG. 7 of an installation scenario in which an attachment is installed on an inner container according to the prior art.

In FIG. 10 a corresponding sectional view according to FIG. 6 is shown in a schematic view, wherein here an embodiment of a cut-out hole according to the prior art is shown. In this embodiment it may be identified that a rear end 16' of the cut-out hole 13' is configured in the plane E' (to be understood relative to the installation direction P). Thus, as may be identified in FIG. 10, the front end region 23' of the sealing element 23' abuts against the edge contour 14' and then according to the arrow P1 is possibly even completely bent to the rear or kinked to the rear and/or undesirably folded up until it is pushed over this sharp edge of the edge contour 14'. In this case, the end region 23*a'* may be torn or otherwise frayed, such that when it subsequently bears against the outer face 9*a* it no longer bears thereagainst in a fully sealed manner.

LIST OF REFERENCE NUMERALS

1 Household refrigeration appliance
2 Housing
3 Outer housing
4, 4' Inner container
5, 5' Receiving area
6 Wall
7 Wall
8 Wall
9 Wall

9*a* Outer face
10 Wall
11 Intermediate space
12 Insulating foam
13 Cut-out hole
13' Cut-out hole
14 Edge contour
14' Edge contour
15 Edge contour portion
16 End
16' End
17 Hole pocket
18 Pocket wall
19 Edge contour
20 Edge contour portion
21 End edge
22 Attachment
23 Sealing element
23*a* End region
23' Sealing element
23*a*' End region
24 End
25 Transition
26 Coupling projection
27 Base
28 Top wall
28*a* Top wall edge
28*b* Top wall strip
B Breadth
B Hole axis
E Plane
E' Plane
W Width
P Installation direction
P1 Installation direction

The invention claimed is:

1. An inner container for a household refrigeration appliance, the inner container comprising:

a plane having mutually opposite first and second sides;

walls delimiting at least portions of a receiving area for food;

said walls including a wall having a cut-out hole formed therein, said cut-out hole having an end, said cut-out hole being delimited by an edge contour, and said edge contour having a first edge contour portion extending entirely in said plane and a second edge contour portion not extending in said plane;

a separate attachment configured to be installed at said cut-out hole to at least partly cover said cut-out hole, said attachment having a sealing element disposed entirely over a periphery of said attachment;

said sealing element being located on said first side of said plane and said second edge contour portion being located on said second side of said plane; and said wall having an elevated hole pocket formed therein adjoining said end of said cut-out hole, said hole pocket extending from said plane, said hole pocket having a diagonal pocket wall, and said diagonal pocket wall forming a guide ramp for said attachment upon installing said attachment on said wall.

2. The inner container according to claim 1, wherein said cut-out hole has a clear width, and at least one of said hole pocket or said diagonal pocket wall extends over said clear width of said cut-out hole.

3. The inner container according to claim 1, wherein said diagonal pocket wall leads with an end edge onto said wall and said end edge runs in said plane.

4. The inner container according to claim 3, wherein said edge contour is closed over a periphery, and said first edge contour portion extends entirely in said plane from which said hole pocket extends.

5. The inner container according to claim 3, which further comprises a transition from said end edge into said wall being configured without edges.

6. The inner container according to claim 1, wherein said hole pocket has a free edge contour portion forming a stop for said attachment.

7. The inner container according to claim 1, wherein said wall has a base with a top wall, and said cut-out hole is formed in said top wall of said base.

8. The inner container according to claim 7, wherein said base is formed in one piece with said wall.

9. The inner container according to claim 7, wherein said top wall has a total surface, and said cut-out hole has a cut-out portion with a total surface corresponding to less than 100% of said total surface of said top wall, as seen in a perpendicular projected view onto said top wall.

10. The inner container according to claim 9, wherein said total surface of said cut-out portion corresponds to at least 70% of said total surface of said top wall, as seen in said perpendicular projected view onto said top wall.

11. The inner container according to claim 9, wherein said total surface of said cut-out portion corresponds to at least 80% of said total surface of said top wall, as seen in said perpendicular projected view onto said top wall.

12. A household refrigeration appliance, comprising:

a housing including an outer housing and an inner container according to claim 1;

said inner container being disposed in said outer housing and defining an intermediate space between said inner container and said outer housing; and a thermally insulating material filling at least some regions of said intermediate space;

said attachment being installed on said inner container, being at least partly disposed in said intermediate space and at least partly covering said cut-out hole in said wall of said inner container.

13. The household refrigeration appliance according to claim 12, wherein:

said inner container has an outer face facing said intermediate space;

said attachment has the sealing element bearing against said outer face of said inner container;

said attachment at least partly covers said hole pocket toward said intermediate space; and said sealing element outside said hole pocket bears against said outer face of said inner container.

14. The household refrigeration appliance according to claim 13, wherein said sealing element has a diagonally inclined outer end region.

15. The household refrigeration appliance according to claim 12, wherein said attachment is formed in one piece.

16. The household refrigeration appliance according to claim 15, wherein said attachment is a plastic injection-molded component.

17. The inner container according to claim 1, wherein said edge contour has a closed periphery.

18. A method for installing an attachment on a wall of an inner container for a household refrigeration appliance, the method comprising:

providing an inner container already manufactured with an outer face and an elevated hole pocket facing away from the outer face;

pushing the attachment in an installation direction oriented perpendicularly or substantially perpendicularly to a hole axis of a cut-out hole formed in the wall, against the outer face of the inner container and over the cut-out hole;

delimiting the cut-out hole at one end, as viewed in the installation direction, by the elevated hole pocket;

providing the hole pocket with a diagonal pocket wall forming a guide ramp for the attachment upon installing the attachment on the wall or on the cut-out hole;

bringing the attachment into contact with the diagonal pocket wall with the displacement of the attachment in the installation direction;

sliding the attachment along the pocket wall with a further displacement of the attachment in the installation direction and guiding the attachment over a transition between the pocket wall and the wall until the attachment bears against the outer face in an installed end position; and pushing the attachment sufficiently far over the cut-out hole until a projection of the attachment bears against a free edge contour portion of the hole pocket.

19. The method according to claim 18, which further comprises delimiting the cut-out hole by an edge contour having a remaining edge contour portion, the projection extending outside a plane in which the remaining edge contour portion extends without the hole pocket.

20. The method according to claim 18, which further comprises:

providing an intermediate installation position from which the installation of the attachment is carried out by displacement in the installation direction;

positioning the attachment in the intermediate installation position such that, when viewed in the installation direction, a portion of the attachment facing the hole pocket and being located closest to the hole pocket is disposed with an outer end region overlapping with the pocket wall in a direction of a longitudinal axis of the cut-out hole or is positioned on the pocket wall.

21. The method according to claim 18, which further comprises positioning the attachment, in a preliminary installation step, onto the wall in a direction perpendicular to the installation direction, and extending the attachment into the cut-out hole to reach an intermediate installation position starting from which a further installation is carried out by the displacement in the installation direction.

22. An inner container for a household refrigeration appliance, the inner container comprising:

a plane having mutually opposite first and second sides;

walls delimiting at least portions of a receiving area for food;

said walls including a wall having a cut-out hole formed therein, said cut-out hole having an end, said cut-out hole being delimited by an edge contour, and said edge contour having a first edge contour portion extending entirely in said plane and a second edge contour portion not extending in said plane;

a separate attachment configured to be installed at said cut-out hole to at least partly cover said cut-out hole; and said wall having an elevated hole pocket formed therein adjoining said end of said cut-out hole, said hole pocket having a diagonal pocket wall, and said diagonal pocket wall forming a guide ramp for said attachment upon installing said attachment on said wall, and said hole pocket and positions of said first edge contour portion and said second edge contour portion relative to said plane being formed during production of said inner container.

23. The inner container according to claim 22, wherein said edge contour has a closed periphery.

* * * * *